US008671626B1

(12) United States Patent
Marty et al.

(10) Patent No.: US 8,671,626 B1
(45) Date of Patent: Mar. 18, 2014

(54) APPARATUS AND METHOD FOR A DRILLING RIG ASSEMBLY

(75) Inventors: Dan Marty, Valley City, OH (US); Eddie Stuckert, Cleveland, OH (US); Kalpeshkumar Patel, Akron, OH (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 13/545,133

(22) Filed: Jul. 10, 2012

Related U.S. Application Data

(60) Provisional application No. 61/572,087, filed on Jul. 11, 2011.

(51) Int. Cl.
*E21B 15/00* (2006.01)

(52) U.S. Cl.
USPC ..... 52/117; 52/123.1; 175/85; 414/22.55

(58) Field of Classification Search
USPC ..... 52/111–121; 414/22.52, 22.53, 22.54, 414/22.5, 22.56, 22.55; 175/85; 173/1, 184, 173/185, 90, 112, 114, 148
See application file for complete search history.

(56) References Cited

U.S. PATENT DOCUMENTS 3,539,024 A * 11/1970 Bleyl et al. ..... 175/85
4,074,774 A * 2/1978 Brown et al. ..... 173/44
4,303,270 A * 12/1981 Adair ..... 294/207
4,403,897 A * 9/1983 Willis ..... 414/22.55
4,547,110 A * 10/1985 Davidson ..... 414/22.55
4,591,006 A * 5/1986 Hutchison et al. ..... 175/52
4,821,816 A * 4/1989 Willis ..... 175/57
5,931,238 A * 8/1999 Gilmore et al. ..... 175/52
7,090,035 B2 * 8/2006 Lesko ..... 175/57
8,083,009 B2 * 12/2011 Comacchio et al. ..... 175/52
8,172,497 B2 * 5/2012 Orgeron et al. ..... 414/22.55
2005/0269133 A1 * 12/2005 Little ..... 175/52

* cited by examiner

*Primary Examiner* — Brian Glessner
*Assistant Examiner* — Beth Stephan
(74) *Attorney, Agent, or Firm* — Chambliss, Bahner & Stophel, P.C.

(57) ABSTRACT

A drilling rig assembly having a longitudinal axis and comprising a drilling rig skid and a derrick assembly having a derrick assembly pivot axis and being adapted to move relative to the drilling rig skid. The derrick assembly comprises a pair of derrick masts disposed on opposite sides of the longitudinal axis and comprising a rack, and a carriage assembly being substantially disposed between the pair of derrick masts, being adapted to move along the pair of derrick masts and comprising a pinion. The drilling rig assembly also comprises a means for moving the derrick assembly relative to the drilling rig skid, a pipe loader assembly having a pipe loader assembly pivot axis, and a means for moving the pipe loader assembly relative to the drilling rig skid. The derrick assembly pivot axis and the pipe loader assembly pivot axis are co-axial.

15 Claims, 7 Drawing Sheets

APPARATUS AND METHOD FOR A DRILLING RIG ASSEMBLY

CROSS-REFERENCES TO RELATED APPLICATIONS/PATENTS

This application relates back to and claims priority from U.S. Provisional Application for Patent No. 61/572,087 titled "Apparatus and Method for Drilling Rig" and filed on Jul. 11, 2011.

FIELD OF THE INVENTION

The present invention relates generally to drilling rig assemblies, and particularly to derrick and pipe loader assemblies for drilling rigs.

BACKGROUND AND DESCRIPTION OF THE PRIOR ART

It is known to provide a drilling rig assembly with derrick and pipe loader assemblies adapted to be moved so as to align drill pipe sections and the like. Conventional derrick and pipe loader assemblies on drilling rig assemblies, however, suffer from one or more disadvantages. For example, conventional derrick assemblies are either rack-and-pinion or dual mast assemblies. As a result, conventional derrick assemblies having a rack-and-pinion assembly can provide downward force on a drill pipe section, but the rack must be offset from the longitudinal axis or hole center causing undesirable overhung load and limited open space for working and tooling. Conventional derrick assemblies having a dual mast assembly use a cable system which avoids overhung loads but is not capable of providing any downward force on the drill pipe sections without undesirable supplemental cable systems. Conventional derrick and pipe loader assemblies also do not have a pipe loader assembly pivot axis that is co-linear with the derrick assembly pivot axis. As a result, conventional derrick and pipe loader assemblies cannot align drill pipe sections at all derrick mast angles and locations without separate adjustment of each assembly. Conventional derrick and pipe loader assemblies are also undesirably expensive, complex and heavy. In addition, in conventional drilling rig assemblies, the pipe loader assembly is not integral with the drilling rig skid. Conventional drilling rig assemblies also have derrick assemblies and pipe loader assemblies that cannot be adjusted together as a unit. Further, in conventional drilling rig assemblies, the pipe loader assembly is not disposed directly beneath the derrick assembly and it must be adjusted separately from the derrick assembly when the derrick assembly is adjusted.

It would be desirable, therefore, if an apparatus and method for a drilling rig assembly could be provided that would include a rack-and-pinion, dual mast derrick assembly adapted to provide downward force to a drill string section, avoid overhung load and maximize open space for working and tooling. It would also be desirable if such an apparatus and method could be provided that would have a pipe loader assembly pivot axis that is co-linear with the derrick assembly pivot axis. It would be further desirable if such an apparatus and method could be provided that would align drill pipe sections at all derrick mast angles and locations. It would be still further desirable if such an apparatus and method could be provided that would be inexpensive, simple and light. In addition, it would be desirable if such an apparatus and method could be provided that would integrate the pipe loader assembly with the drilling rig skid. It would also be desirable if such an apparatus and method could be provided that would permit the derrick assembly and the pipe loader assembly to be adjusted together as a unit. Further, it would be desirable if such an apparatus and method could be provided in which the pipe loader assembly is disposed directly beneath the derrick assembly and it does not require separate adjustment when the derrick assembly is adjusted.

Advantages of the Preferred Embodiments of the Invention

It is an advantage of the preferred embodiments of the invention described and claimed herein to provide an apparatus and method for a drilling rig assembly that includes a rack-and-pinion, dual mast derrick assembly adapted to provide downward force to a drill string section, avoid overhung load and maximize open space for working and tooling. It is also an advantage of the preferred embodiments of the invention to provide an apparatus and method for a drilling rig assembly that has a pipe loader assembly pivot axis that is co-linear with the derrick assembly pivot axis. It is a further advantage of the preferred embodiments of the invention to provide an apparatus and method for a drilling rig assembly that is adapted to align drill pipe sections at all derrick mast angles and locations. It is a still further advantage of the preferred embodiments of the invention to provide an apparatus and method for a drilling rig assembly that is relatively inexpensive to manufacture, maintain and repair, simple in design and light-weight. In addition, it is an advantage of the preferred embodiments of the invention to provide an apparatus and method for a drilling rig assembly having a derrick assembly and pipe loader assembly that are an integral part of the drilling rig skid. It is also an advantage of the preferred embodiments of the invention to provide an apparatus and method for a drilling rig assembly having a derrick assembly and pipe loader assembly that may be adjusted together as a unit. It is a further advantage of the preferred embodiments of the invention to provide an apparatus and method for a drilling rig assembly having a pipe loader assembly that is disposed beneath the derrick assembly and that does not require adjustment separate from the adjustment of the derrick assembly.

Additional advantages of the preferred embodiments of the invention will become apparent from an examination of the drawings and the ensuing description.

SUMMARY OF THE INVENTION

The apparatus of the invention comprises a drilling rig assembly having a longitudinal axis and comprising a drilling rig skid adapted to support the drilling rig assembly and a derrick assembly having a derrick assembly pivot axis and being adapted to move relative to the drilling rig skid. The derrick assembly comprises a pair of derrick masts disposed on opposite sides of the longitudinal axis and comprising a rack, and a carriage assembly being substantially disposed between the pair of derrick masts, being adapted to move along the pair of derrick masts and comprising a pinion. The drilling rig assembly also comprises a means for moving the derrick assembly relative to the drilling rig skid that is adapted to move the derrick assembly relative to the drilling rig skid, a pipe loader assembly having a pipe loader assembly pivot axis and being adapted to move relative to the drilling rig skid, and a means for moving the pipe loader assembly relative to the drilling rig skid that is adapted to move the pipe loader assembly relative to the drilling rig skid. The derrick assembly pivot axis and the pipe loader assembly pivot axis are co-axial.

The method of the invention comprises a method for drilling. The method comprises providing a drilling rig assembly having a longitudinal axis and comprising a drilling rig skid adapted to support the drilling rig assembly and a derrick assembly having a derrick assembly pivot axis and being adapted to move relative to the drilling rig skid. The derrick assembly comprises a pair of derrick masts disposed on opposite sides of the longitudinal axis and comprising a rack, and a carriage assembly being substantially disposed between the pair of derrick masts, being adapted to move along the pair of derrick masts and comprising a pinion. The drilling rig assembly also comprises a means for moving the derrick assembly relative to the drilling rig skid that is adapted to move the derrick assembly relative to the drilling rig skid, a pipe loader assembly having a pipe loader assembly pivot axis and being adapted to move relative to the drilling rig skid, and a means for moving the pipe loader assembly relative to the drilling rig skid that is adapted to move the pipe loader assembly relative to the drilling rig skid. The derrick assembly pivot axis and the pipe loader assembly pivot axis are co-axial. The method also comprises moving the derrick assembly relative to The drilling rig skid and moving the pipe loader assembly relative to the drilling rig skid.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
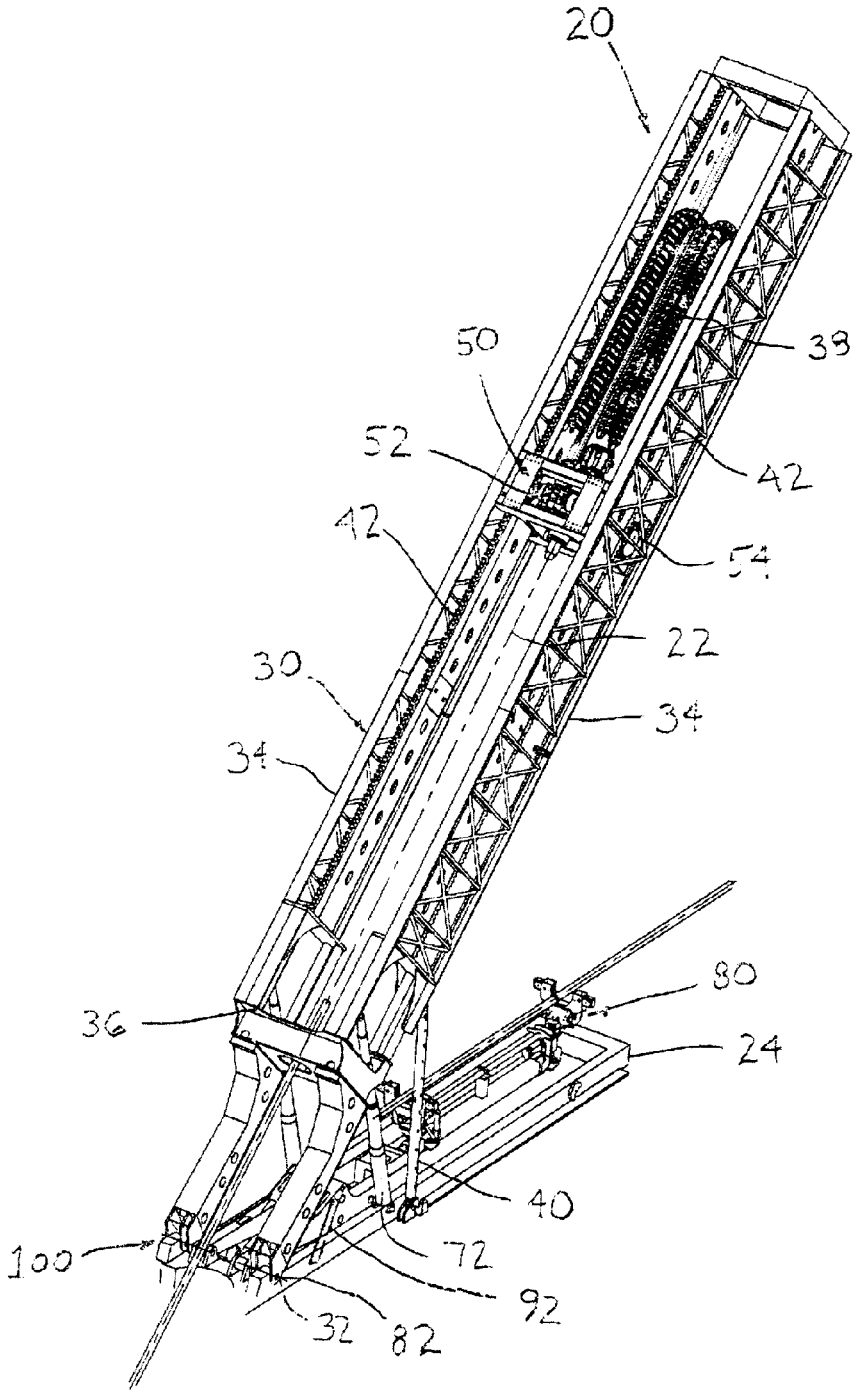
FIG. 1 is a perspective view of the preferred embodiment of the drilling rig assembly in accordance with the present invention.

Referring now to the drawings, the preferred embodiment of the drilling rig assembly in accordance with the present invention is illustrated by FIGS. 1 through 7. As shown in FIGS. 1-7, the preferred embodiments of the invention provide an apparatus and method for a drilling rig assembly that includes a rack-and-pinion, dual mast derrick assembly adapted to provide downward force to a drill string section, avoid overhung load and maximize open space for working and tooling. The preferred embodiments of the invention also provide an apparatus and method for a drilling rig assembly having a pipe loader assembly pivot axis that is co-linear with the derrick assembly pivot axis. The preferred embodiments of the invention further provide an apparatus and method for a drilling rig assembly that is adapted to align drill pipe sections at all derrick mast angles and locations. The preferred embodiments of invention still further provides an apparatus and method for a drilling rig assembly that is relatively inexpensive to manufacture, maintain and repair, simple in design and light-weight. In addition, the preferred embodiments of the invention provide an apparatus and method for a drilling rig assembly having a derrick assembly and pipe loader assembly that are an integral part of the drilling rig skid. The preferred embodiments of the invention also provide an apparatus and method for a drilling rig assembly having a derrick assembly and pipe loader assembly that may be adjusted together as a unit. The preferred embodiments of the invention further provide an apparatus and method for a drilling rig assembly having a pipe loader assembly that is disposed beneath the derrick assembly and that does not require adjustment separate from the adjustment of the derrick assembly.

Referring now to FIG. 1, a perspective view of the preferred embodiment of the drilling rig assembly in accordance with the present invention is illustrated. As shown in FIG. 1, the preferred drilling rig is designated generally by reference numeral 20. The preferred drilling rig assembly 20 has longitudinal axis 22 and comprises drilling rig skid 24. Preferred drilling rig skid 24 is adapted to support drilling rig assembly 20 and is disposed substantially directly beneath the derrick assembly and the pipe loader assembly. While FIG. 1 illustrates the preferred configuration and arrangement of drilling rig skid 24, it is contemplated within the scope of the invention that the drilling rig skid may be of any suitable configuration and arrangement.

Still referring to FIG. 1, preferred drilling rig assembly 20 comprises derrick assembly 30 which is pivotally attached to drilling rig skid 24. Preferred derrick assembly 30 has derrick assembly pivot axis 32 and is adapted to move relative to drilling rig skid 24. Preferably, derrick assembly 30 pivotally moves relative to drilling rig skid 24. Preferred derrick assembly 30 comprises a pair of derrick masts 34 which are disposed on opposite sides of longitudinal axis 22. Preferably, the pair of derrick masts 34 are disposed symmetrically on opposite sides of longitudinal axis 22. The preferred derrick assembly 30 also comprises drill floor 36. Preferred drill floor 36 is adapted to provide a surface upon which workers can walk when the drilling rig is at various angles. The preferred derrick assembly 30 further comprises hose carrier 38. Preferred hose carrier 38 is adapted to organize and maintain the various hoses when the drilling rig is at various angles. The preferred drilling rig assembly 20 still further comprises strut 40. Preferred strut 40 is disposed between derrick mast 34 and drilling rig skid 24 and is adapted to provide support to derrick assembly 30. In addition, preferred derrick masts 34 comprise racks 42. Preferably, each derrick mast 34 comprises a pair of racks 42 which are welded to the derrick masts and are adapted to operatively engage with a pinion on the carriage assembly so as to move the carriage assembly along the derrick assembly as described below. Preferably, derrick assembly 30 is integral with drilling rig skid 24. While FIG. 1 illustrates the preferred configuration and arrangement of derrick assembly 30, it is contemplated within the scope of the invention that the derrick assembly may be of any suitable configuration and arrangement. It is also contemplated within the scope of the invention that derrick assembly 30 may be removably attached to drilling rig skid 24.

Still referring to FIG. 1, preferred derrick assembly 30 also comprises carriage assembly 50 which is substantially disposed between the pair of derrick masts 34. The preferred carriage assembly 50 comprises hydraulic motion system 52. Preferred hydraulic motion system 52 is adapted to move carriage assembly 50 along derrick assembly 30. The preferred hydraulic motion system 52 is controlled remotely with a controller such as a microprocessor or programmable logic controller. Preferred carriage assembly 50 further comprises pinions 54 which are adapted to operatively engage racks 42 so as to move the carriage assembly along the pair of derrick masts 34. While FIG. 1 illustrates the preferred configuration and arrangement of carriage assembly 50, it is contemplated within the scope of the invention that the carriage assembly may be of any suitable configuration and arrangement.

Still referring to FIG. 1, preferred drilling rig assembly 20 comprises a means for moving the derrick assembly relative to the drilling rig skid. The preferred means for moving the derrick assembly relative to the drilling rig skid is adapted to move derrick assembly 30 relative to drilling rig skid 24. Preferably, the means for moving the derrick assembly relative to the drilling rig skid comprises a derrick assembly actuator such as derrick assembly hydraulic cylinder 72. The means for moving the derrick assembly relative to the drilling rig skid is preferably controlled remotely with a controller such as a microprocessor or programmable logic controller. The preferred means for moving the derrick assembly relative to the drilling rig skid is adapted to move derrick assembly so that drilling rig assembly 20 may be operated at angles between zero degrees(0°) and approximately fifty-five degrees(55°) from vertical. It is contemplated within the scope of the invention, however, that the preferred drilling assembly 20 may be operated at any angle, including without limitation, vertical. While FIG. 1 illustrates the preferred configuration and arrangement of means for moving the derrick assembly relative to the drilling rig skid, it is contemplated within the scope of the invention that the means for moving the derrick assembly relative to the drilling rig skid may be of any suitable configuration and arrangement. In addition, it is contemplated within the scope of the invention that the means for moving the derrick assembly relative to the drilling rig skid may comprise any manual, mechanical or automated device, mechanism, assembly or combination thereof that is adapted to move the derrick assembly relative to the drilling rig skid, including without limitation, a linear actuator, a rotary actuator, a pneumatic cylinder, a jack screw, a motor and chain assembly, a motor and cable assembly, a motor and gear assembly, a motor and link assembly and the like.

Still referring to FIG. 1, preferred drilling rig assembly 20 comprises pipe loader assembly 80 which is pivotally attached to drilling rig skid 24. Preferred pipe loader assembly 80 has pipe loader assembly pivot axis 82. Preferably, pipe loader assembly 80 pivotally moves relative to drilling rig skid. Preferred pipe loader assembly 80 is adapted to move relative to drilling rig skid 24. Preferably, pipe loader assembly 80 is disposed substantially directly beneath the derrick assembly 30 and is integral with the derrick assembly and drilling rig skid 24. While FIG. 1 illustrates the preferred configuration and arrangement of pipe loader assembly 80, it is contemplated within the scope of the invention that the pipe loader assembly may be of any suitable configuration and arrangement. It is also contemplated within the scope of the invention that pipe loader assembly 80 may be removably attached to drilling rig skid 24.

Still referring to FIG. 1, preferred drilling rig assembly 20 comprises a means for moving the pipe loader assembly relative to the drilling rig skid. The preferred means for moving the pipe loader assembly relative to the drilling rig skid is adapted to move pipe loader assembly 80 relative to drilling rig skid 24. Preferably, the means for moving the pipe loader assembly relative to the drilling rig skid comprises a pipe loader assembly actuator such as pipe loader assembly hydraulic cylinder 92. The means for moving the pipe loader assembly relative to the drilling rig skid is preferably controlled remotely with a controller such as a microprocessor or programmable logic controller. While FIG. 1 illustrates the preferred configuration and arrangement of means for moving the pipe loader assembly relative to the drilling rig skid, it is contemplated within the scope of the invention that the means for moving the pipe loader assembly relative to the drilling rig skid may be of any suitable configuration and arrangement. In addition, it is contemplated within the scope of the invention that the means for moving the pipe loader assembly relative to the drilling rig skid may comprise any manual, mechanical or automated device, mechanism, assembly or combination thereof that is adapted to move the pipe loader assembly relative to the drilling rig skid, including without limitation, a linear actuator, a rotary actuator, a pneumatic cylinder, a jack screw, a motor and chain assembly, a motor and cable assembly, a motor and gear assembly, a motor and link assembly and the like.

Still referring to FIG. 1, preferred drilling rig assembly 20 comprises pivot assembly 100. Preferred pivot assembly 100 is disposed adjacent to derrick assembly pivot axis 32 and pipe loader assembly pivot axis 82. Preferably, derrick assembly pivot axis 32 and pipe loader assembly pivot axis 82 are co-axial. As shown in FIG. 1, preferred pivot assembly comprises the proximal ends of derrick assembly 30, pipe loader assembly 80 and drilling rig skid 24. While FIG. 1 illustrates the preferred configuration and arrangement of pivot assembly 100, it is contemplated within the scope of the invention that the pivot assembly may be of any suitable configuration and arrangement.

Figure 2:
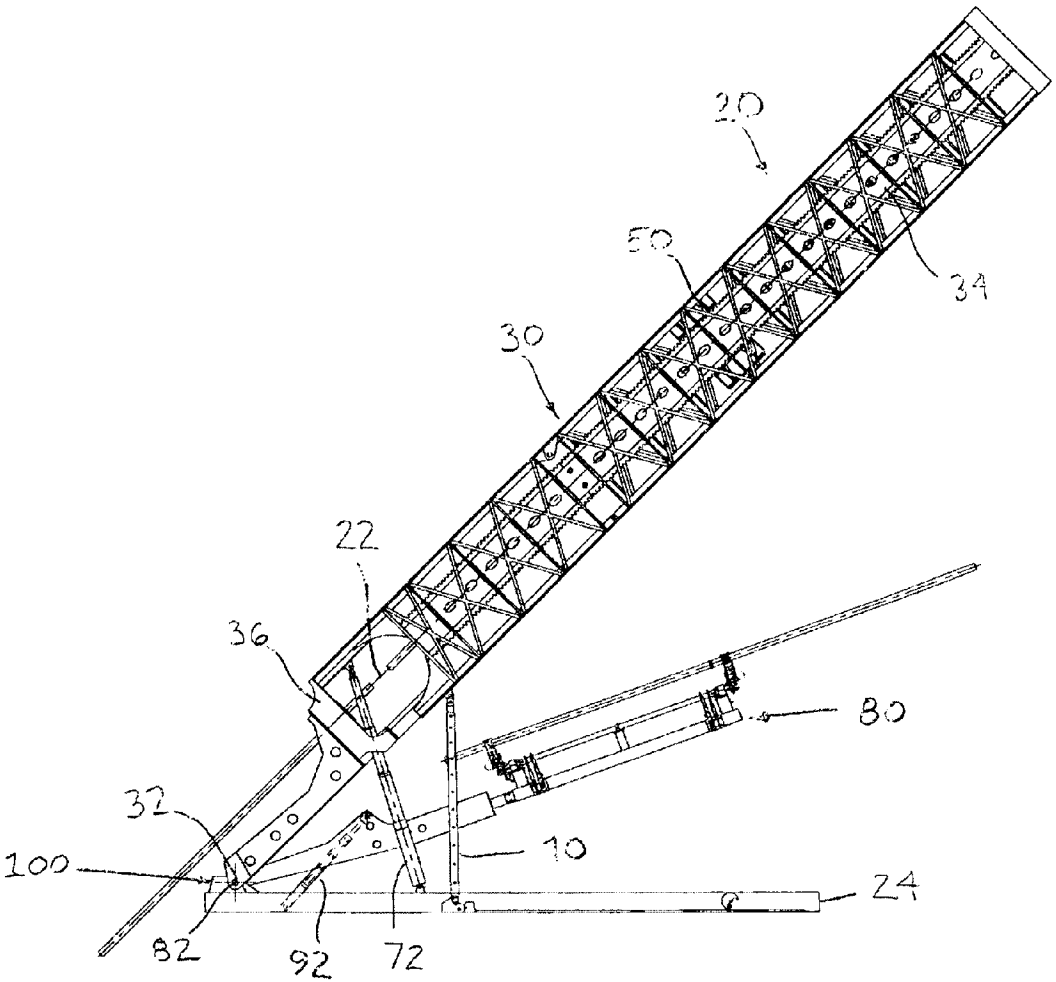
FIG. 2 is a front view of the preferred drilling rig assembly illustrated in FIG. 1.

Referring now to FIG. 2, a front view of preferred drilling rig assembly 20 is illustrated. As shown in FIG. 2, preferred drilling rig assembly 20 comprises longitudinal axis 22, drilling rig skid 24, derrick assembly 30, derrick assembly pivot axis 32, derrick mast 34, drill floor 36, strut 40, carriage assembly 50, derrick assembly hydraulic cylinder 72, pipe loader assembly 80, pipe loader assembly pivot axis 82, pipe loader assembly hydraulic cylinder 92 and pivot assembly 100.

Figure 3:
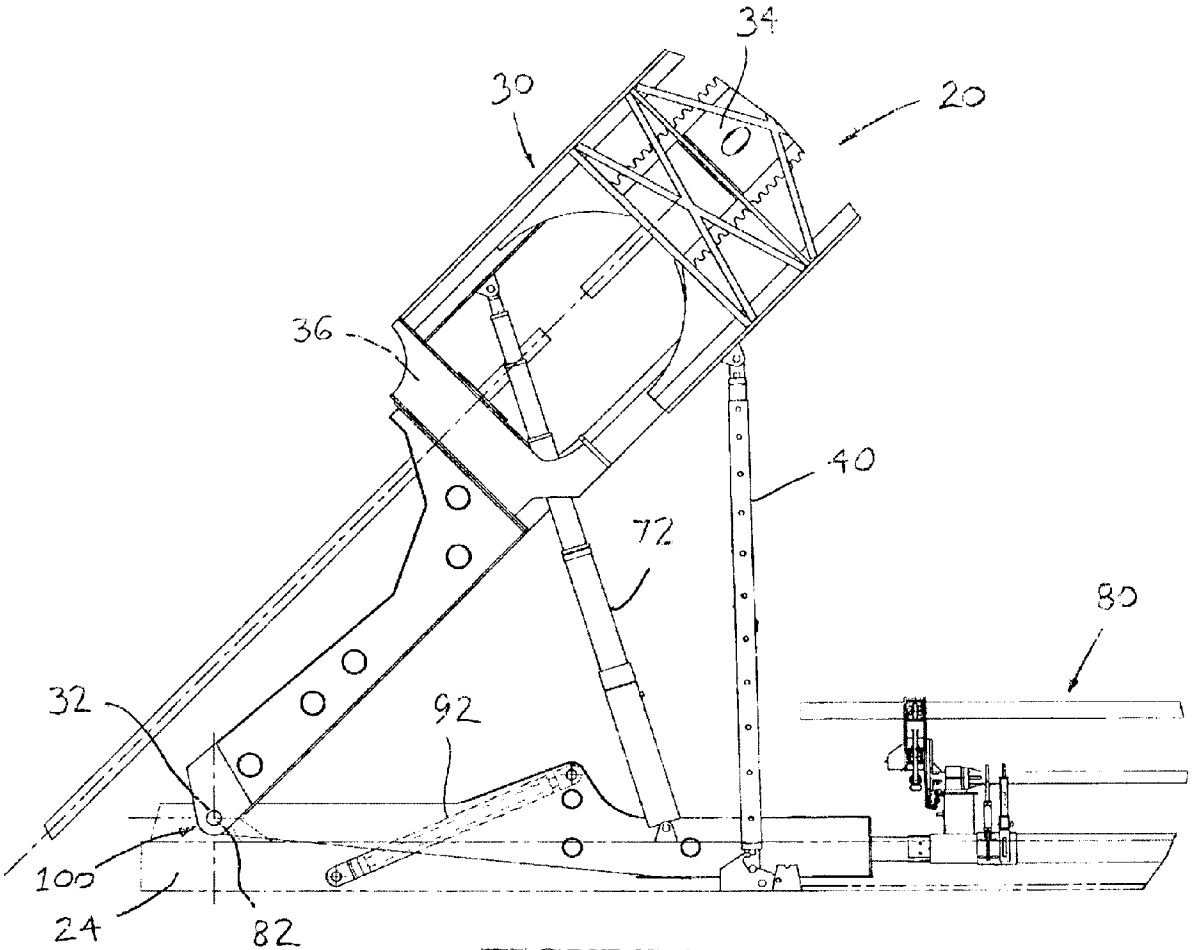
FIG. 3 is a front view of the pivot assembly of the preferred drilling rig assembly illustrated in FIGS. 1 and 2.

Referring now to FIG. 3, a front view of preferred pivot assembly 100 of drilling rig assembly 20 is illustrated. As shown in FIG. 3, preferred drilling rig assembly 20 comprises drilling rig skid 24, derrick assembly 30, derrick assembly pivot axis 32, derrick mast 34, drill floor 36, strut 40, derrick assembly hydraulic cylinder 72, pipe loader assembly 80, pipe loader assembly pivot axis 82, pipe loader assembly hydraulic cylinder 92 and pivot assembly 100.

Figure 4:
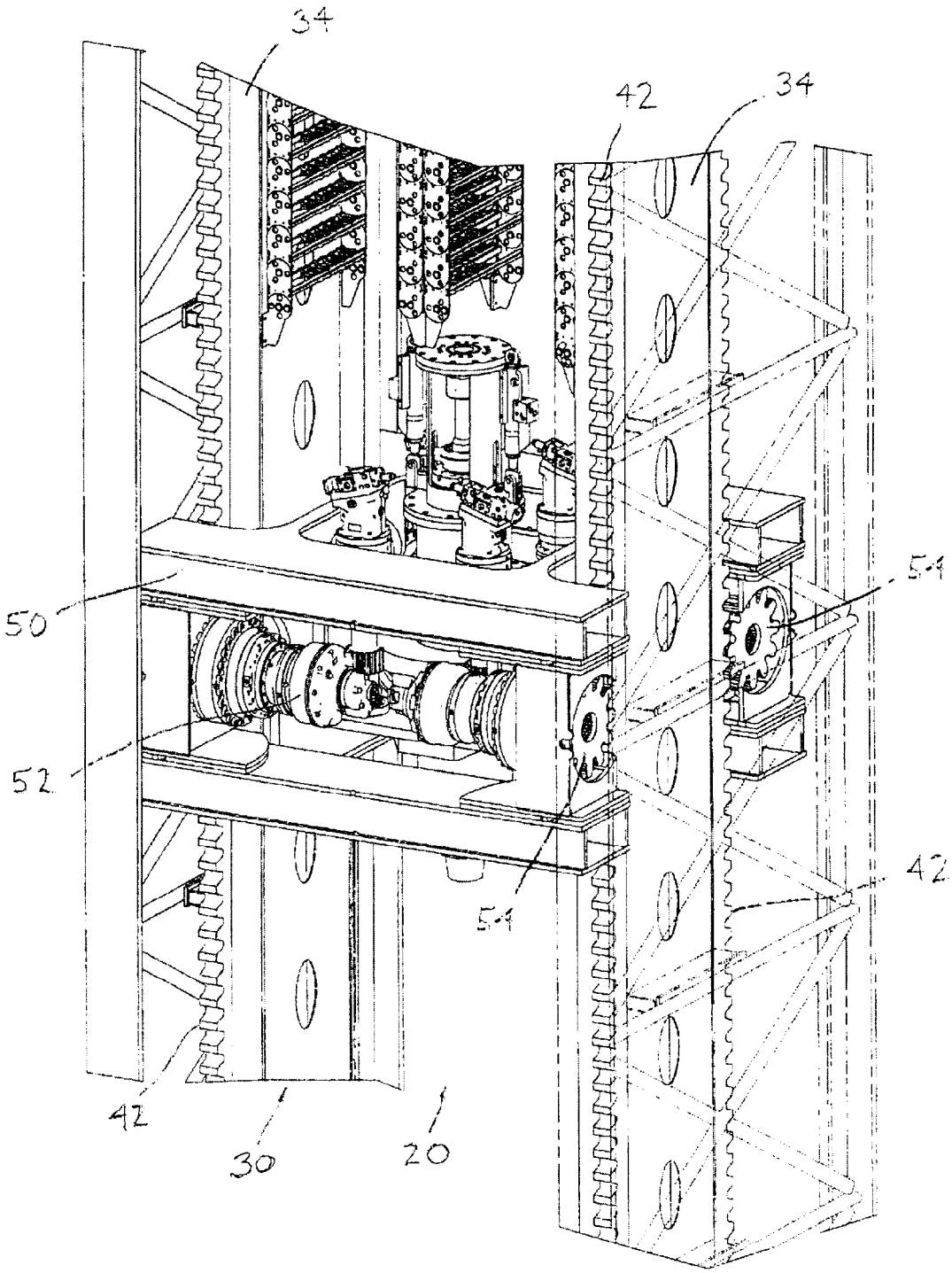
FIG. 4 is a perspective view of the dual masts and carriage assembly of the preferred drilling rig assembly illustrated in FIGS. 1-3.

Referring now to FIG. 4, a perspective view of the preferred pair of masts 34 and carriage assembly 50 of drilling rig assembly 20 is illustrated. As shown in FIG. 4, preferred drilling rig assembly 20 comprises derrick assembly 30, derrick masts 34, racks 42, carriage assembly 50, hydraulic motion system 52 and pinions 54.

Figure 5:
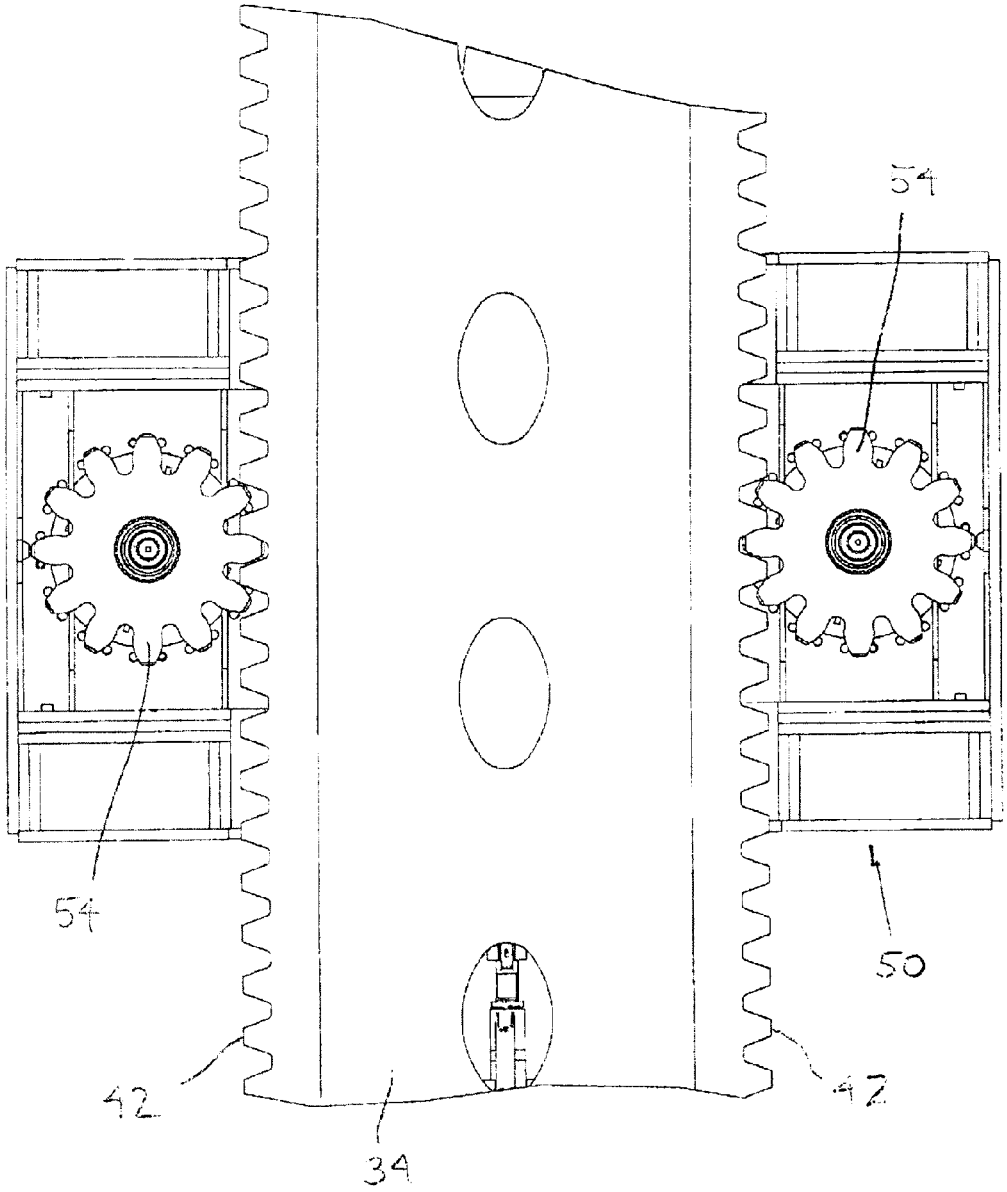
FIG. 5 is a front view of the carriage assembly of the preferred drilling rig assembly illustrated in FIGS. 1-4.

Referring now to FIG. 5, a front view of preferred carriage assembly 50 of drilling rig assembly 20 is illustrated. As shown in FIG. 5, the preferred drilling rig assembly 20 comprises derrick mast 34, racks 42, carriage assembly 50 and pinions 54.

Figure 6:
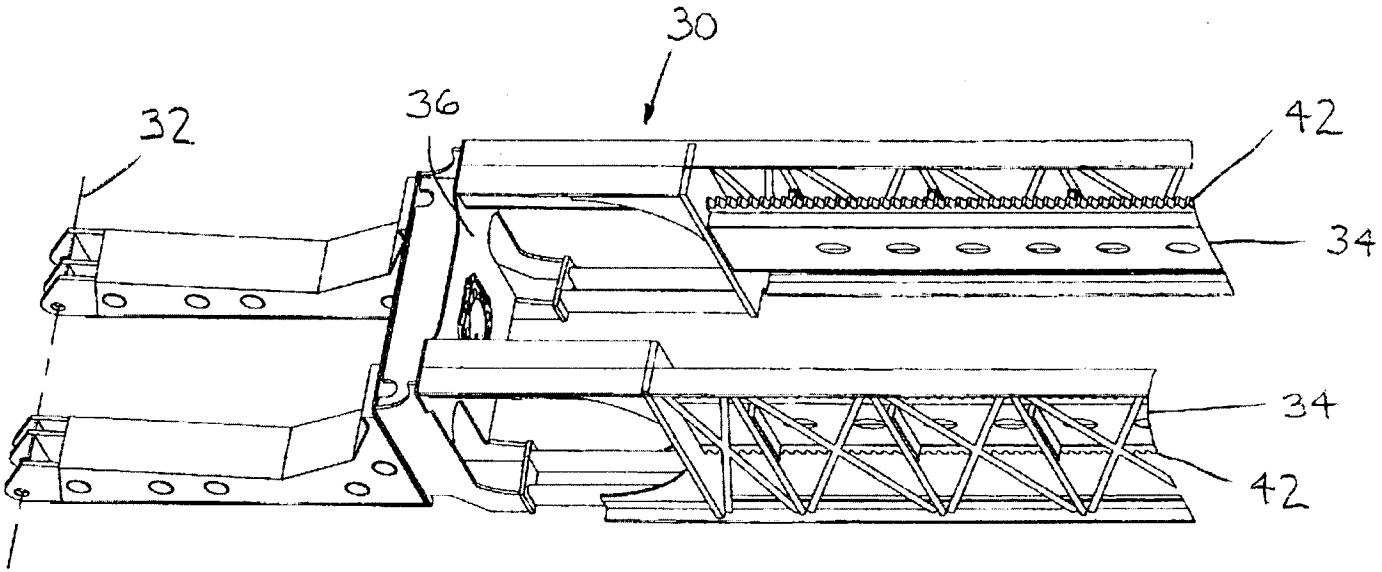
FIG. 6 is a perspective isolated view of the derrick assembly of the preferred drilling rig assembly illustrated in FIGS. 1-5.

Referring now to FIG. 6, a perspective isolated view of derrick assembly 30 of the preferred drilling rig assembly is illustrated. As shown in FIG. 6, preferred derrick assembly 30 comprises derrick assembly pivot axis 32, derrick masts 34, drill floor 36 and racks 42.

Figure 7:
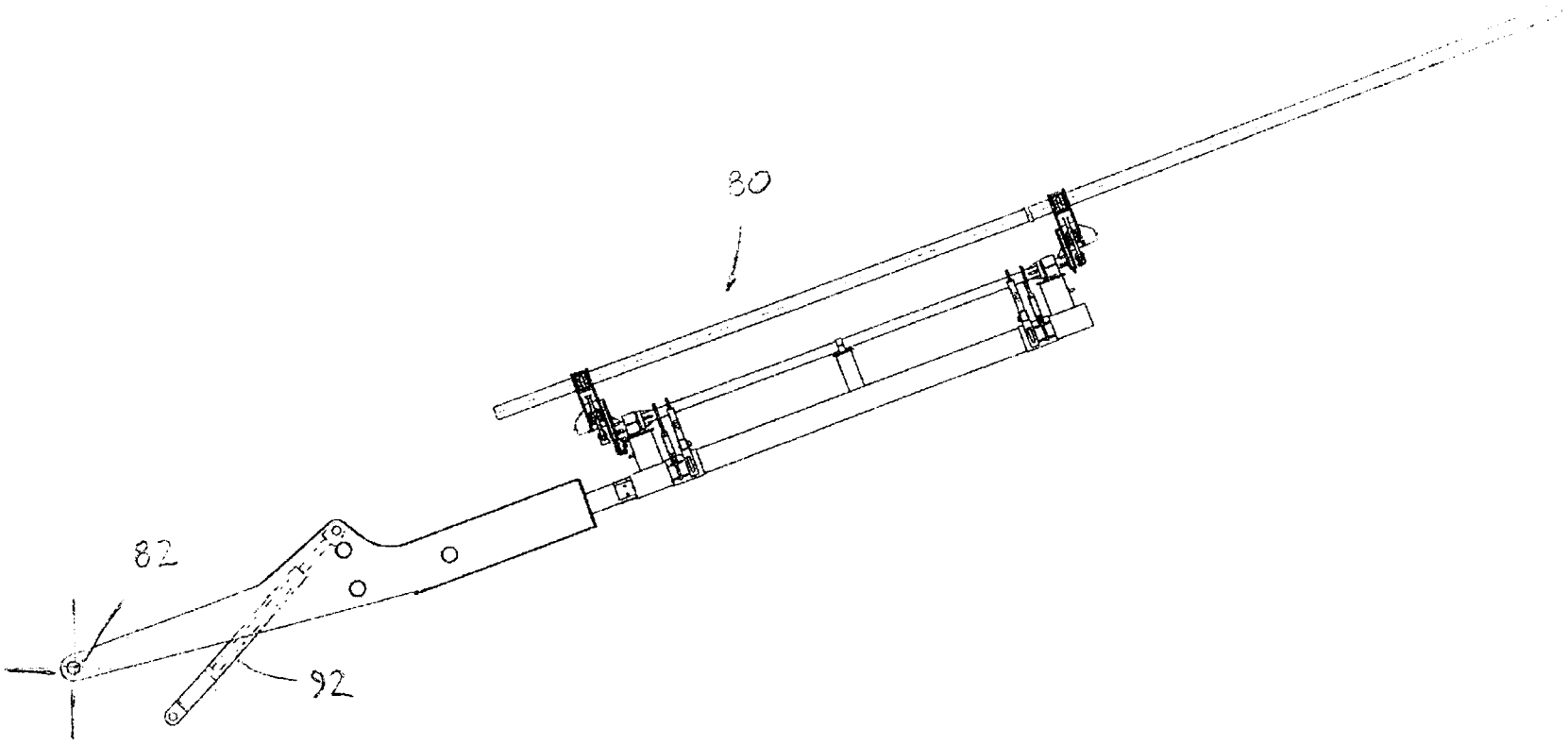
FIG. 7 is a perspective isolated view of the pipe loader assembly of the preferred drilling rig assembly illustrated in FIGS. 1-6.

Referring now to FIG. 7, a perspective isolated view of pipe loader assembly 80 of the preferred drilling rig assembly is illustrated. As shown in FIG. 7, preferred pipe loader assembly 80 comprises pipe loader assembly pivot axis 82 and pipe loader assembly hydraulic cylinder 92.

The invention also comprises a method for drilling. The preferred method for drilling comprises providing a drilling rig assembly as described and claimed herein. The method further comprises the steps of moving the derrick assembly and the pipe loader assembly relative to the drilling rig skid. Preferably, the derrick assembly and pipe loader assembly are moved pivotally relative to the drilling rig skid.

In operation, several advantages of the preferred embodiments of the invention are achieved. For example, the preferred embodiments of the invention provide an apparatus and method for a drilling rig assembly that includes a rack-and-pinion, dual mast derrick assembly adapted to provide downward force to a drill string section, avoid overhung load and maximize open space for working and tooling. The preferred embodiments of the invention also provide an apparatus and method for a drilling rig assembly having a pipe loader assembly pivot axis that is co-linear with the derrick assembly pivot axis. The preferred embodiments of the invention further provide an apparatus and method for a drilling rig assembly that is adapted to align drill pipe sections at all derrick mast angles and locations. The preferred embodiments of invention still further provides an apparatus and method for a drilling rig assembly that is relatively inexpensive to manufacture, maintain and repair, simple in design and light-weight. In addition, the preferred embodiments of the invention provide an apparatus and method for a drilling rig assembly having a derrick assembly and pipe loader assembly that arc an integral part of the drilling rig skid. The preferred embodiments of the invention also provide an apparatus and method for a drilling rig assembly having a derrick assembly and pipe loader assembly that may be adjusted together as a unit. The preferred embodiments of the invention further provide an apparatus and method for a drilling rig assembly having a pipe loader assembly that is disposed beneath the derrick assembly and that does not require adjustment separate from the adjustment of the derrick assembly.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A drilling rig assembly, said drilling rig assembly having a longitudinal axis and comprising:

(a) a drilling rig skid, said drilling rig skid supporting the drilling rig assembly;

(b) a derrick assembly pivotally attached to the drilling rig skid at a derrick assembly pivot axis, the derrick assembly adapted to move relative to the drilling rig skid and comprising;

(1) a pair of derrick masts, said pair of derrick masts being disposed on opposite sides of the longitudinal axis and comprising at least one rack;

(2) a carriage assembly, said carriage assembly being substantially disposed between the pair of derrick masts, the carriage assembly being adapted to move along the pair of derrick masts and comprising a pinion;

(c) a means for moving the derrick assembly relative to the drilling rig skid, said means for moving the derrick assembly relative to the drilling rig skid being adapted to move the derrick assembly relative to the drilling rig skid;

(d) a pipe loader assembly pivotally attached to the drilling rig skid at a pipe loader assembly pivot axis, the pipe loader assembly adapted to move relative to the drilling rig skid;

(e) a means for moving the pipe loader assembly relative to the drilling rig skid, said means for moving the pipe loader assembly relative to the drilling rig skid being adapted to move the pipe loader assembly relative to the drilling rig skid;

wherein the derrick assembly pivot axis and the pipe loader assembly pivot axis are co-axial.

2. The drilling rig assembly of claim 1 further comprising a strut, said strut being disposed between the pair of derrick masts and the drilling rig skid.

3. The drilling rig assembly of claim 1 wherein the derrick assembly comprises a drill floor.

4. The drilling rig assembly of claim 1 wherein the derrick assembly comprises a hose carrier.

5. The drilling rig assembly of claim 1 further comprising a pivot assembly, said pivot assembly being disposed adjacent to the derrick assembly pivot axis and the pipe loader assembly pivot axis.

6. The drilling rig assembly of claim 5 wherein the pivot assembly is disposed adjacent to the derrick assembly pivot axis and the pipe loader assembly pivot axis.

7. The drilling rig assembly of claim 1 wherein the pair of masts are disposed symmetrically on opposite sides of the longitudinal axis.

8. The drilling rig assembly of claim 1 wherein the carriage assembly comprises a hydraulic motion system.

9. The drilling rig assembly of claim 1 wherein the at least one rack is disposed on each of the pair of derrick masts.

10. The drilling rig assembly of claim 1 wherein the means for moving the derrick assembly relative to the drilling rig skid comprises a derrick assembly actuator.

11. The drilling rig assembly of claim 1 wherein the means for moving the derrick assembly relative to the drilling rig skid comprises a derrick assembly hydraulic cylinder.

12. The drilling rig assembly of claim 1 wherein the means for moving the pipe loader assembly relative to the drilling rig skid comprises a pipe loader assembly actuator.

13. The drilling rig assembly of claim 1 wherein the pipe loader assembly is disposed beneath the derrick assembly.

14. The drilling rig assembly of claim 1 wherein the means for moving the pipe loader assembly relative to the drilling rig skid comprises a pipe loader assembly hydraulic cylinder.

15. A method for drilling, said method comprising:

(a) providing a drilling rig assembly, said drilling rig assembly having a longitudinal axis and comprising:

(1) a drilling rig skid, said drilling rig skid supporting the drilling rig assembly;

(2) a derrick assembly pivotally attached to the drilling rig skid at a derrick assembly pivot axis, the derrick assembly adapted to move relative to the drilling rig skid and comprising;

(i) a pair of derrick masts, said pair of derrick masts being disposed on opposite sides of the longitudinal axis and comprising a rack;

(ii) a carriage assembly, said carriage assembly being substantially disposed between the pair of derrick masts, the carriage assembly being adapted to move along the pair of derrick masts and comprising a pinion;

(3) a means for moving the derrick assembly relative to the drilling rig skid, said means for moving the derrick assembly relative to the drilling rig skid being adapted to move the derrick assembly relative to the drilling rig skid;

(4) a pipe loader assembly pivotally attached to the drilling rig skid at a pipe loader assembly pivot axis, the pipe loader assembly adapted to move relative to the drilling rig skid;

(5) a means for moving the pipe loader assembly relative to the drilling rig skid, said means for moving the pipe loader assembly relative to the drilling rig skid being adapted to move the pipe loader assembly relative to the drilling rig skid;

wherein the derrick assembly pivot axis and the pipe loader assembly pivot axis are co-axial;

(b) moving the derrick assembly relative to the drilling rig skid;

(c) moving the pipe loader assembly relative to the drilling rig skid.

* * * * *